US010947830B2

(12) United States Patent
Zhang et al.

(10) Patent No.: US 10,947,830 B2
(45) Date of Patent: Mar. 16, 2021

(54) FRACTURING METHOD FOR CREATING COMPLEX CRACK NETWORK BY INTERMITTENT FRACTURING ON SITE

(71) Applicant: China University of Petroleum—Beijing, Beijing (CN)

(72) Inventors: Guangqing Zhang, Beijing (CN); Yuanxun Nie, Beijing (CN); Cankun Lin, Beijing (CN)

(73) Assignee: China University of Petroleum—Beijing, Beijing (CN)

( * ) Notice: Subject to any disclaimer, the term of this patent is extended or adjusted under 35 U.S.C. 154(b) by 17 days.

(21) Appl. No.: 16/257,254

(22) Filed: Jan. 25, 2019

(65) Prior Publication Data

US 2020/0056465 A1 Feb. 20, 2020

(30) Foreign Application Priority Data

Aug. 15, 2018 (CN) ..... 201810927321.4

(51) Int. Cl.

*E21B 43/26* (2006.01)
*E21B 43/20* (2006.01)
*E21B 47/18* (2012.01)

(52) U.S. Cl.

CPC ..... *E21B 43/26* (2013.01); *E21B 43/20* (2013.01); *E21B 47/18* (2013.01)

(58) Field of Classification Search

CPC ..... E21B 43/26; E21B 43/20; E21B 47/18
See application file for complete search history.

(56) References Cited

U.S. PATENT DOCUMENTS 3,933,205 A * 1/1976 Kiel ..... E21B 43/26 166/308.1
7,127,353 B2 * 10/2006 Geiser ..... G01V 1/306 702/13

(Continued)

FOREIGN PATENT DOCUMENTS

CN 103306660 A 9/2013
CN 107816340 A 3/2018

(Continued)

OTHER PUBLICATIONS

Tan Xin, Study on Method and Technology of Horizontal Well Fracturing Stimulation for Tight Sand Oil & Gas Reservoir, pp. 36-40, Aug. 15, 2016.

(Continued)

*Primary Examiner* — Aaron L Lembo
(74) *Attorney, Agent, or Firm* — Young Basile Hanlon & MacFarlane, P.C.

(57) ABSTRACT

A fracturing method for creating a complex crack network by intermittent fracturing on site, which relates to oil and gas field development, and comprises the following steps: pumping a fracturing fluid into an oil well to enter the reservoir, continuing pumping the fracturing fluid into fractured cracks after a pumping pressure has reached a preset pressure, and stopping pumping the fracturing fluid after a preset condition has been reached; performing under-pressure shut-in for the oil well; stopping the shut-in operation when a signal detecting vehicle cannot receive an obvious microseismic signal in the under-pressure shut-in process; repeating the above three steps multiple times; pumping the fracturing fluid into the oil well to enter the reservoir by the fracturing truck until an amount of the pumped in fracturing fluid reaches a design pump-in liquid amount; pumping a sand-carrying fluid into the oil well to enter the reservoir by means of a sand blending truck and the fracturing truck after (Continued)

the amount of the pumped in fracturing fluid has reached the design pump-in liquid amount, and stopping pumping the sand-carrying fluid after the pumped in sand-carrying fluid has reached a preset sand adding amount.

11 Claims, 4 Drawing Sheets

(56) References Cited

U.S. PATENT DOCUMENTS

| | | | | |
|---|---|---|---|---|
| 7,819,191 | B2 * | 10/2010 | Miller | C09K 8/62 166/281 |
| 8,347,959 | B2 * | 1/2013 | Suarez-Rivera | E21B 43/26 166/250.1 |
| 8,498,852 | B2 * | 7/2013 | Xu | E21B 43/26 703/10 |
| 8,908,473 | B2 * | 12/2014 | Bradford | G01V 1/30 367/38 |
| 8,978,764 | B2 * | 3/2015 | Dusseault | E21B 43/26 166/308.1 |
| 9,103,200 | B2 * | 8/2015 | Baihly | E21B 43/26 |
| 9,140,109 | B2 * | 9/2015 | Suarez-Rivera | E21B 43/26 |
| 9,217,318 | B2 * | 12/2015 | Dusterhoft | E21B 43/25 |
| 9,297,250 | B2 * | 3/2016 | Dusterhoft | E21B 43/26 |
| 9,683,165 | B2 * | 6/2017 | Mendell | E21B 43/26 |
| 9,879,514 | B2 * | 1/2018 | Ciezobka | E21B 43/267 |
| 10,001,003 | B2 * | 6/2018 | Dusseault | E21B 43/267 |
| 10,060,241 | B2 * | 8/2018 | Xu | E21B 47/065 |
| 10,329,888 | B2 * | 6/2019 | Urbancic | E21B 43/26 |
| 10,344,204 | B2 * | 7/2019 | Mendell | C09K 8/703 |
| 10,385,257 | B2 * | 8/2019 | Mendell | E21B 43/26 |
| 10,385,258 | B2 * | 8/2019 | Mendell | C09K 8/703 |
| 10,572,829 | B1 * | 2/2020 | Willinger | G01V 1/308 |
| 2004/0094300 | A1 * | 5/2004 | Sullivan | C09K 8/52 166/308.1 |
| 2010/0096129 | A1 * | 4/2010 | Hinkel | E21B 43/16 166/270.1 |
| 2013/0075086 | A1 | 3/2013 | Press | |
| 2014/0151033 | A1 * | 6/2014 | Xu | E21B 43/00 166/250.01 |
| 2016/0003020 | A1 * | 1/2016 | Sharma | E21B 43/26 166/250.1 |
| 2018/0266227 | A1 * | 9/2018 | Santarelli | E21B 43/26 |
| 2018/0306015 | A1 * | 10/2018 | Shetty | E21B 43/26 |
| 2018/0371874 | A1 * | 12/2018 | Shetty | E21B 43/26 |
| 2019/0078424 | A1 * | 3/2019 | Copeland | E21B 43/26 |
| 2019/0106619 | A1 * | 4/2019 | Nguyen | C09K 8/601 |
| 2019/0136678 | A1 * | 5/2019 | Mendell | E21B 43/26 |
| 2019/0136680 | A1 * | 5/2019 | Madasu | C09K 8/62 |
| 2019/0145225 | A1 * | 5/2019 | Zhang | G05B 13/042 |
| 2019/0145238 | A1 * | 5/2019 | Lin | G06F 17/11 |
| 2019/0177604 | A1 * | 6/2019 | Belakshe | E21B 33/138 |
| 2019/0309604 | A1 * | 10/2019 | Madasu | E21B 41/00 |
| 2019/0309610 | A1 * | 10/2019 | Nguyen | C04B 28/006 |

FOREIGN PATENT DOCUMENTS

| | | | |
|---|---|---|---|
| CN | 108240209 | A | 7/2018 |
| CN | 108266171 | A | 7/2018 |
| CN | 108343416 | A | 7/2018 |
| WO | 2018/035498 | A1 | 2/2018 |

OTHER PUBLICATIONS

First Chinese Office Action and Search Report for Application No. 201810927321.4 dated Aug. 5, 2019.

* cited by examiner

FRACTURING METHOD FOR CREATING COMPLEX CRACK NETWORK BY INTERMITTENT FRACTURING ON SITE

TECHNICAL FIELD

The present invention relates to the technical field of oil and gas fields development, in particular to a fracturing method for creating a complex crack network by intermittent fracturing on site.

BACKGROUND

Hydraulic fracturing technique is the most commonly employed measure for increasing production in the development of tight sandstone reservoirs and shale reservoirs. The selection of fracturing methods has a significant influence on the production per well for oil wells in tight sandstone reservoirs and shale reservoirs. As to the conventional fracturing on site, a water-based fracturing fluid is usually adopted to perform the fracturing job. During pump injection, slickwater is first of all used to perform fracturing, and then a sand-carrying fracturing fluid is used to perform fracturing and support the cracks. However, the cracks formed by the conventional hydraulic fracturing in tight sandstone reservoirs and shale reservoirs has relatively low complexity, and the production per well of the oil wells will decrease rapidly after a period time of production. Therefore, the conventional hydraulic fracturing has great limitations in developing oil fields of tight sandstone reservoirs and shale reservoirs.

In order to form complex cracks in tight sandstone reservoirs and shale reservoirs, the method of high energy gas fracturing has been tried in conducting fracturing on site. This fracturing method uses rocket propellants as fuels. Ignition of injected propellants can produce gases containing high energy, and thereby multiple cracks will be formed in the reservoir under an instantaneous high pressure. However, the high energy gas fracturing method has a very high requirement for fracturing equipment, and also has greater risks, and thus is rarely adopted on site. Apart from the above mentioned two fracturing methods, supercritical carbon dioxide fracturing and liquid nitrogen fracturing, as have been tried for many times in field fracturing, can also create a multi-crack system. However, the two fracturing methods both have a high requirement for fracturing equipment, the gas sources are not stable, and it is hard to ensure safety. Thus, the two methods have not been applied on a large scale on site yet.

SUMMARY

In order to overcome the above deficiencies of the prior art, the technical problem to be solved by the embodiments of the present invention is to provide a fracturing method for creating a complex crack network by intermittent fracturing on site, which can form a complex crack network system for tight sandstone reservoirs and shale reservoirs on the premise of low cost, with a low requirement for fracturing equipment in the process of fracturing on site.

The specific technical solution of the embodiments of the present invention is:

A fracturing method for creating a complex crack network by intermittent fracturing on site, comprising the following steps:

pumping a fracturing fluid into an oil well to enter a reservoir by means of a fracturing truck, continuing pumping the fracturing fluid into fractured cracks after a pumping pressure has reached a preset pressure, and stopping pumping in the fracturing fluid after a preset condition has been reached;

performing under-pressure shut-in for the oil well;

stopping the shut-in operation when a signal detecting vehicle cannot receive an obvious microseismic signal in the under-pressure shut-in process;

repeating multiple times the steps from pumping the fracturing fluid into the oil well to enter the reservoir by means of the fracturing truck, continuing pumping the fracturing fluid into fractured cracks after a pumping pressure has reached a preset pressure and stopping pumping in the fracturing fluid after a preset condition has been reached, to stopping the shut-in operation when the signal detecting vehicle cannot receive an obvious microseismic signal in the under-pressure shut-in process;

pumping the fracturing fluid into the oil well to enter the reservoir by means of the fracturing truck until an amount of the pumped in fracturing fluid reaches a design pump-in liquid amount;

pumping a sand-carrying fluid into the oil well to enter the reservoir by means of a sand blending truck and the fracturing truck after the amount of the fracturing fluid pumped in has reached the design pump-in liquid amount, and stopping pumping in the sand-carrying fluid after the amount of the sand-carrying fluid pumped in has reached a preset sand adding amount.

In a preferred embodiment, the preset pressure is a rupturing pressure.

In a preferred embodiment, the preset condition is that the time for continuing pumping the fracturing fluid into the fractured cracks is greater than or equal to two minutes.

In a preferred embodiment, the fracturing fluid is a slickwater fracturing fluid.

In a preferred embodiment, the sand-carrying fluid is pumped into the oil well to enter the reservoir by means of the sand blending truck and the fracturing truck so as to form a high-flow oil and gas channel.

In a preferred embodiment, an injection pump of the fracturing truck is closed during the under-pressure shut-in process of the oil well.

In a preferred embodiment, in the under-pressure shut-in process, a sound emission situation in the pumping process of the fracturing fluid is detected by a high performance radio detector of the signal detecting truck, and the shut-in operation is stopped when the signal detecting truck cannot receive an obvious microseismic signal.

In a preferred embodiment, an initial fractured crack is formed in the phase of performing under-pressure shut-in for the oil well for the first time.

In a preferred embodiment, a subsequent fractured crack is formed in the phase of performing under-pressure shut-in for the oil well after the first time.

In a preferred embodiment, the method further comprises the following step:

mounting a well head, specifically including: connecting a high pressure manifold to a well head apparatus, connecting a fracturing fluid storage tank and a sand storage tank to the sand blending truck, connecting the sand blending truck with the fracturing truck, and connecting the fracturing truck with the high pressure manifold.

The technical solution of the present application has the following remarkable advantageous effect:

The present invention applies intermittent fracturing to enable creation of a complex crack network in tight sandstone reservoirs and shale reservoirs in order to improve the production per well later; besides, in the fracturing process on site, only the fracturing fluid storage tank, the sand storage tank, the fracturing truck, the signal detecting vehicle and the sand blending truck are needed, while other complex apparatuses or dangerous equipment are not demanded, and therefore, it has the characteristic of low requirement for fracturing equipment on site, which endows the whole fracturing process with the advantage of low cost; thus, this method is of great significance for improving the production per well for tight sandstone reservoirs and shale reservoirs.

The present application can form a complex crack network system for tight sandstone reservoirs and shale reservoirs at low cost, and the requirement for fracturing equipment in the fracturing process on site is relatively low.

With reference to the following Description and Figures, the specific embodiments of the present invention have been disclosed in detail, and the way in which the principle of the present invention can be employed has been clearly pointed out. It should be understood, however, that the embodiments of the present invention are not limited thereby in scope. The embodiments of the present invention include a lot of alternations, modifications and equivalents within the scope of spirit and clauses of the appended claims. Features which are described and/or illustrated with respect to one embodiment can be used in the same way or in a similar way in one or more other embodiments, in combination with or instead of the features of the other embodiments.

BRIEF DESCRIPTION OF THE DRAWINGS

The figures described herein are for explanation purpose only and are not intended to limit the scope of disclosure of the present invention in any way. Besides, the shapes and scales of the components in the figures are only illustrative to help understanding the present invention, and are not provided to specifically define the shapes and scales of the components in the present invention. Persons skilled in the art, under the teaching of the present invention, can select various possible shapes and scales to implement the present invention according to concrete situations.

REFERENCE SIGNS IN THE FIGURES

1. fracturing fluid storage tank; 2. sand storage tank; 3. fracturing truck; 4. signal detecting vehicle; 5, sand blending truck; 6. high pressure manifold; 7. well head apparatus; 8. well bore; 9. initial fractured crack; 10. subsequent fractured crack.

DETAILED DESCRIPTION

The details of the present invention can be understood more clearly by combining with the accompanying drawings and the description of the specific embodiments of the present invention. However, the specific embodiments described here are only for the purpose of explanation of the present invention, and cannot be understood as limitations to the present invention in any way. Under the teaching of the present invention, skilled persons can conceive of any possible transformations based on the present invention, which should all be regarded as belonging to the scope of the present invention. It should be clearly stated that when an element is referred to as being "provided on" another element, it can be directly on the other element, or an intervening element may also exist. When an element is referred to as being "connected to" another element, it can be directly connected to the other element, or an intervening element may also exist at the same time. The terms "mount", "connect with" and "connect to" should be understood in broad senses, for example, they may refer to mechanical connection or electrical connection, may refer to communication between the interiors of two components, may refer to direct connection, and may also refer to indirect connection through an intermediate media. For an ordinary person skilled in the art, the specific meaning of the above terms can be understood according to specific situations. The terms "vertical", "horizontal", "up", "down", "left", "right" and similar expressions used in this text are intended for the purpose of explanation only, and do not represent a unique embodiment.

Unless otherwise defined, all the technical and scientific terms used in this text have the same meaning as commonly understood by persons skilled in the technical field of the present application. The terms used in the Description of the present application are for the purpose of describing the specific embodiments only, and are not intended to limit the present application. The term "and/or" used in this text includes any and all combinations of one or more of the associated listed items.

Figure 1:
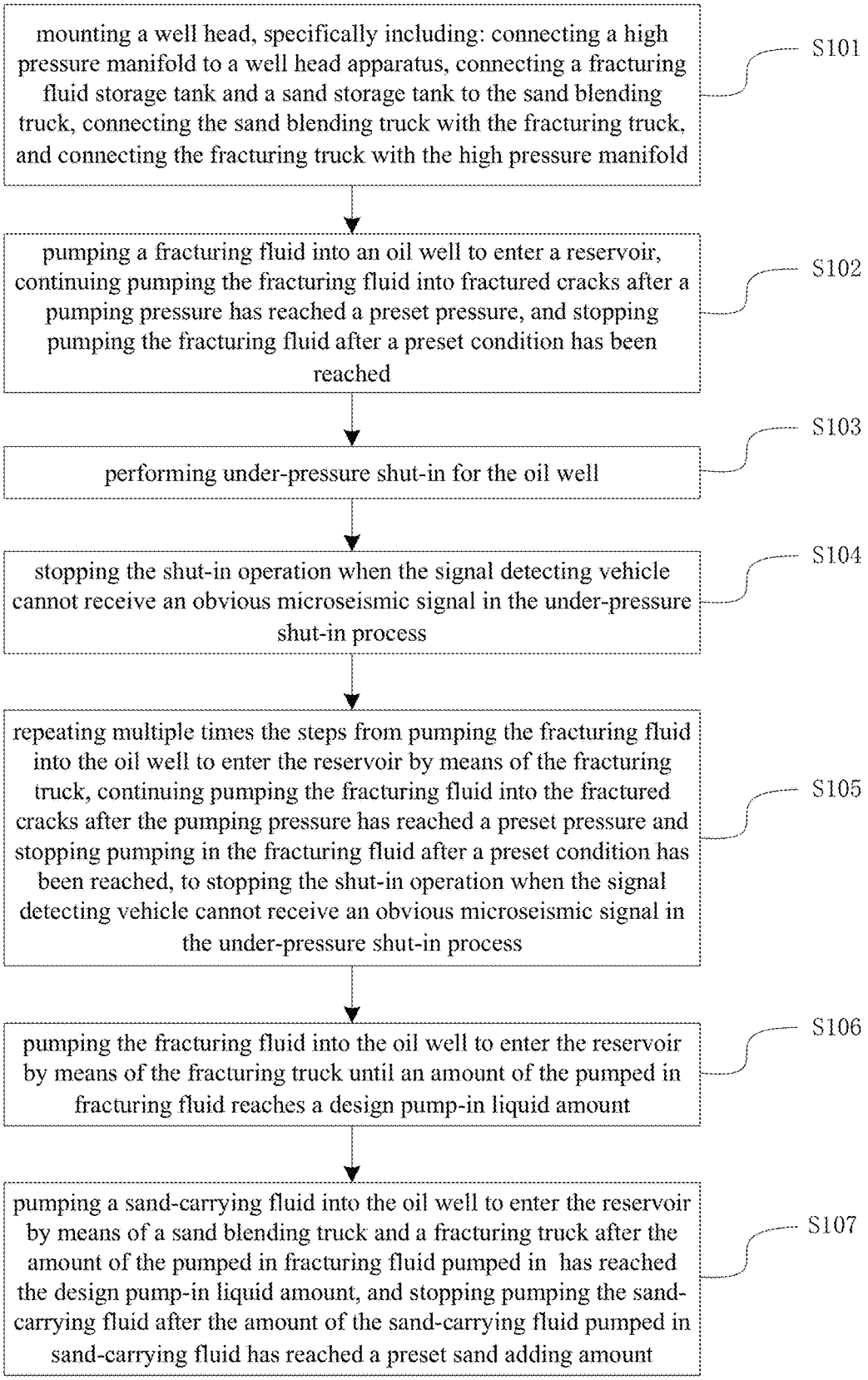
FIG. 1 illustrates a flow chart of the field fracturing method for creating a complex crack network by way of intermittent fracturing in the embodiments of the present invention.

In order to form a complex crack network for tight sandstone reservoirs and shale reservoirs on the premise of low cost, with a low requirement for fracturing equipment in the process of field fracturing, the present application provides a fracturing method for creating a complex crack network by intermittent fracturing on site. FIG. 1 illustrates a flow chart of the fracturing method for creating a complex crack network by intermittent fracturing on site in the embodiments of the present invention. As shown in FIG. 1, the fracturing method for creating a complex crack network by way of intermittent fracturing on site can comprise the following steps.

Figure 3:
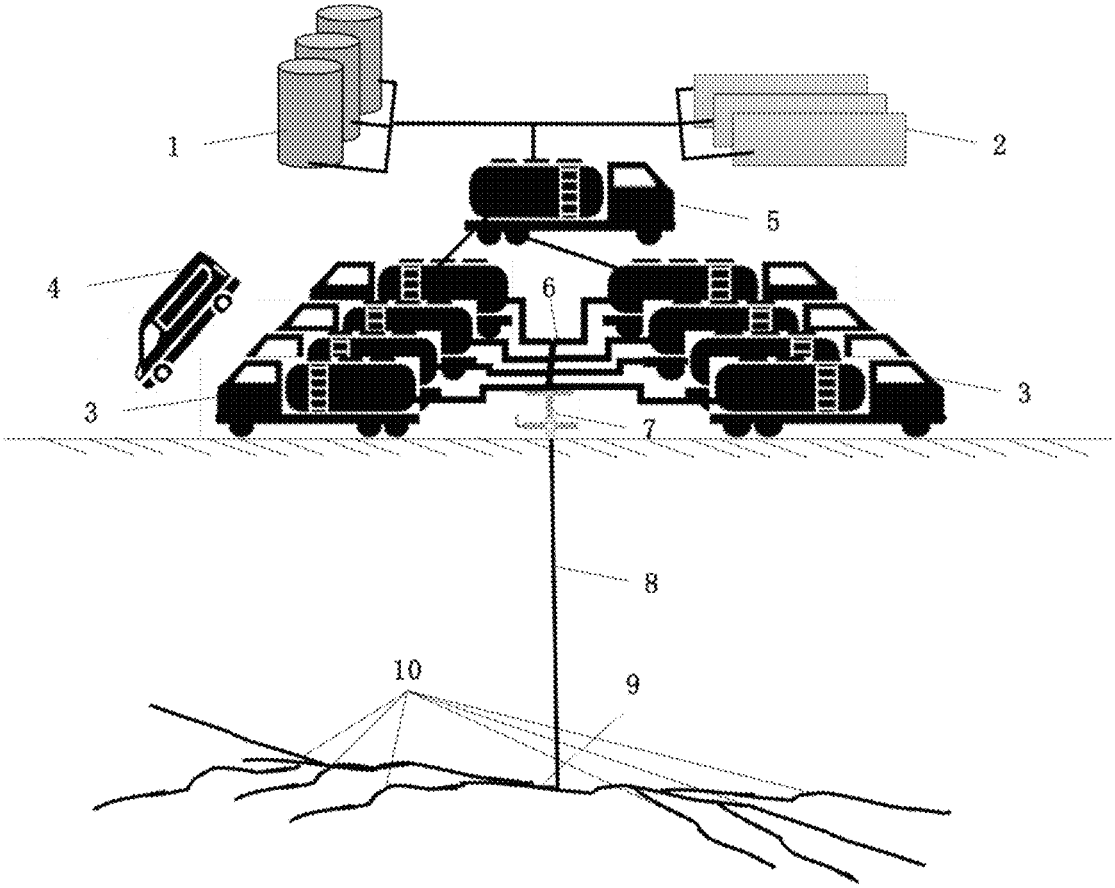
FIG. 3 is a schematic diagram of site construction in the fracturing process in the embodiments of the present invention.

S101: mounting a well head. FIG. 3 illustrates a schematic diagram of site construction in the fracturing process in the embodiments of the present invention. As shown in FIG. 3, this step can specifically comprise: connecting a high pressure manifold 6 to a well head apparatus 7, connecting a fracturing fluid storage tank 1 and a sand storage tank 2 to a sand blending truck 5, connecting the sand blending truck with a fracturing truck 3, and connecting the fracturing truck 3 with the high pressure manifold 6. A lower part of the well head apparatus is connected with a well bore 8.

S102: pumping a fracturing fluid into an oil well to enter a reservoir, continuing pumping the fracturing fluid into fractured cracks after a pumping pressure has reached a preset pressure, and stopping pumping in the fracturing fluid after a preset condition has been reached.

In this step, the fracturing fluid is pumped into the oil well to enter the reservoir by the fracturing truck 3, and at the same time a signal detecting vehicle 4 can be started for detecting an acoustic emission situation during the pumping process of the fracturing fluid. The fracturing fluid is continued to be pumped into the fractured cracks after the pumping pressure has reached a preset pressure, and an injection pump of the fracturing truck 3 is closed to stop pumping in the fracturing fluid after a preset condition has been reached. The preset pressure is a rupturing pressure. The preset condition is that the time for continuing pumping the fracturing fluid into the fractured cracks is greater than or equal to two minutes. In this embodiment, the utilized fracturing fluid is preferably a slickwater fracturing fluid for the reason that it has lower viscosity, which contributes to the formation of fracturing cracks in tight sandstone reservoirs and shale reservoirs in the fracturing process.

S103: performing under-pressure shut-in for the oil well;

In this step, after the pumping of the fracturing fluid into the fracturing cracks has been stopped when a preset condition is reached, under-pressure shut-in is performed for the oil well. The injection pump of the fracturing truck 3 is in a closed state during the under-pressure shut-in process of the oil well. At the same time, a high performance radio detector of the signal detecting vehicle 4 continuously detects the acoustic emission situation during the pumping process of the fracturing fluid. As shown in FIG. 3, an initial fractured crack 9 can be formed in the phase of performing under-pressure shut-in for the oil well for the first time.

Figure 2:
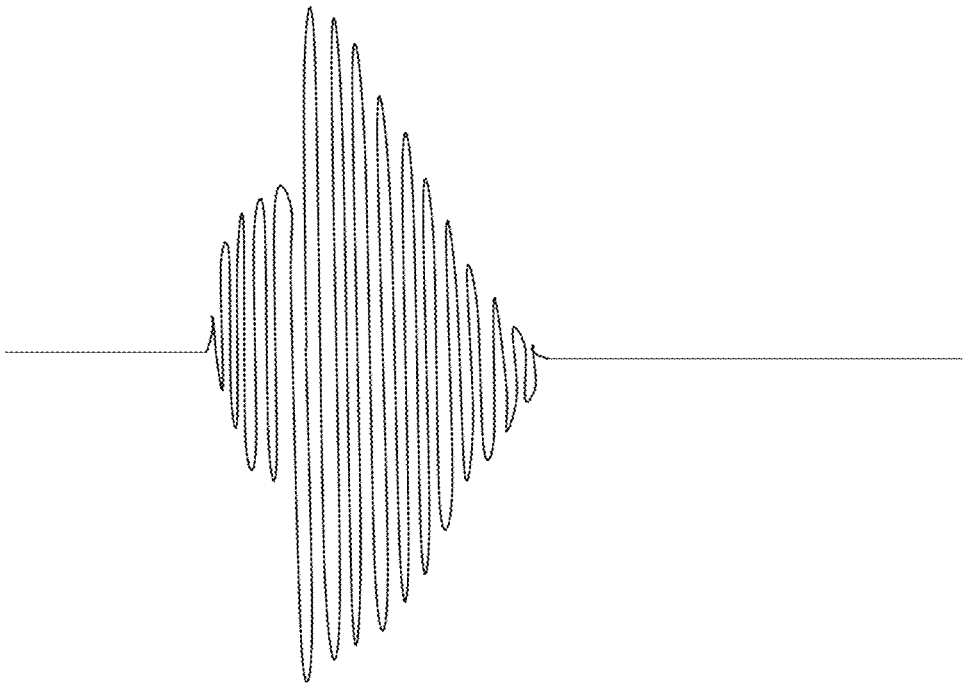
FIG. 2 illustrates a schematic diagram of an obvious microseismic signal detected by a signal detecting vehicle in the embodiments of the present invention.

S104: stopping the shut-in operation when the signal detecting vehicle 4 cannot receive an obvious microseismic signal in the under-pressure shut-in process;

In this step, in the under-pressure shut-in process, FIG. 2 is a schematic diagram of the detected obvious microseismic signal in the embodiments of the present invention. As shown in FIG. 2, the shut-in operation is stopped when the signal detecting vehicle 4 cannot receive an obvious microseismic signal.

Figure 4:
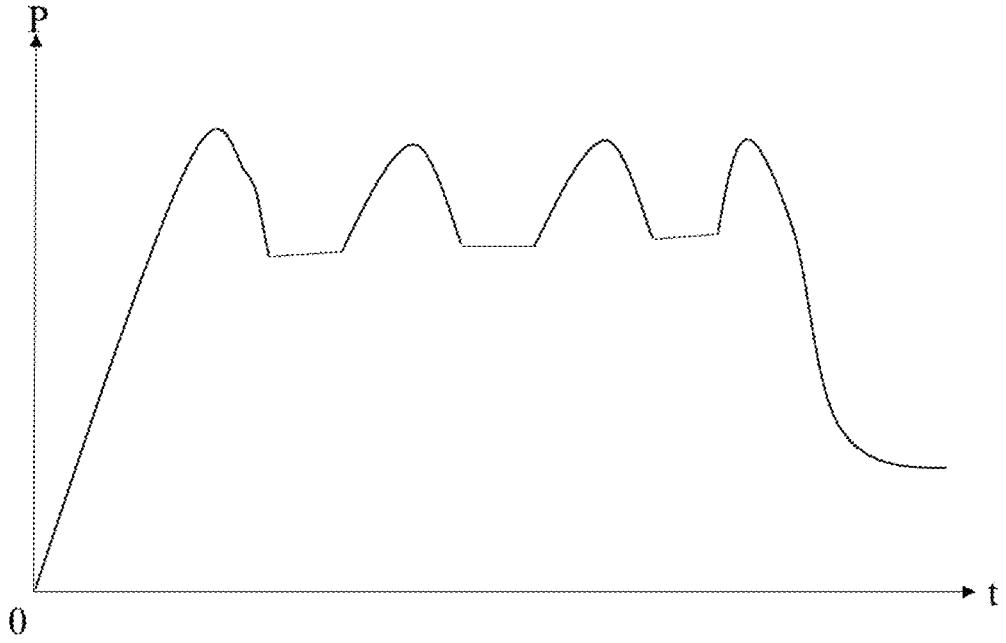
FIG. 4 is a schematic diagram of fracturing fluid discharge volume in the fracturing process in the embodiments of the present invention.

S105: repeating multiple times the steps from pumping the fracturing fluid into the oil well to enter the reservoir by means of the fracturing truck 3, continuing pumping the fracturing fluid into fractured cracks after a pumping pressure has reached a preset pressure and stopping pumping in the fracturing fluid after a preset condition has been reached, to stopping the shut-in operation when the signal detecting vehicle 4 cannot receive an obvious microseismic signal in the under-pressure shut-in process;

In this step, after the shut-in operation has been stopped, the fracturing fluid is pumped again into the oil well to enter the reservoir, the fracturing fluid is continued to be pumped into the fractured cracks after the pumping pressure has reached a preset pressure, and the pumping of the fracturing fluid is stopped after the preset condition has been reached. After the pumping of the fracturing fluid into the fracturing cracks has been stopped when the preset condition is reached, under-pressure shut-in is performed for the oil well. The high performance radio detector of the signal detecting vehicle 4 continuously detects the acoustic emission situation during the pumping process of the fracturing fluid. As shown in FIG. 3, subsequent fractured cracks 10 can be formed after the formation of the initial fractured crack 9 in the phase of performing under-pressure shut-in for the oil well after the first time. The above steps are repeated for multiple times so as to form complex subsequent fracturing cracks 10 after the formation of the initial fracturing crack 9, and thereby form a complete complex crack network system. FIG. 4 is a schematic diagram of the fracturing fluid discharge volume in the fracturing process in the embodiments of the present invention. As shown in FIG. 4, during the whole intermittent fracturing process, the fracturing fluid discharge volume pressed into the reservoir is in a trend as shown in FIG. 4, in which the X axis represents time and the Y axis represents the discharge volume of fracturing fluid.

S106: pumping the fracturing fluid into the oil well to enter the reservoir by means of the fracturing truck 3 until an amount of the pumped in fracturing fluid reaches a design pump-in liquid amount;

In this step, in the above continuously and cyclically performed intermittent fracturing process, the sand-carrying fluid is pumped into a well bore 8 of the oil well to flow into the reservoir by means of a sand blending truck 5 and the fracturing truck 3 after the amount of the pumped in fracturing fluid has reached the design pump-in liquid amount, and the pumping of the sand-carrying fluid is stopped after the sand-carrying fluid has reached a preset sand adding amount. The sand-carrying fluid is pumped into the oil well to enter the reservoir by means of the blending truck 5 and the fracturing truck 3 so as to form a high-flow oil and gas channel by the sands.

The present invention applies intermittent fracturing to enable creation of complex crack networks in tight sandstone reservoirs and shale reservoirs in order to improve the production per well later; besides, in the fracturing process on site, only the fracturing fluid storage tank, the sand storage tank, the fracturing truck, the signal detecting vehicle and the sand blending truck are needed, while other complex apparatuses or dangerous equipment are not demanded, and therefore, it has the characteristic of low requirement for fracturing equipment on site, which endows the whole fracturing process with the advantage of low cost; thus, this method is of great significance for improving the production per well for tight sandstone reservoirs and shale reservoirs.

The disclosures of all articles and references, including patent applications and publications, are incorporated therein by reference for all purposes. The term "substantially consists of . . . " which describes a combination should include the determined elements, components, parts or steps, as well as other elements, components, parts or steps that in substance do not affect the basic novelty feature of the combination. The use of the terms "contain" or "comprise" to describe the combination of the elements, components, parts or steps here also takes into account the embodiments substantially constructed by these elements, components, parts or steps. Here, by using the term "can", it is intended to explain that any described attribute that "can" be included is selectable. Multiple elements, components, parts or steps can be provided by a single integral element, component, part or step. Alternatively, a single integral element, component, part or step can be divided into a plurality of separated elements, components, parts or steps. The terms "a" or "one" used to describe the elements, components, parts or steps are not intended to exclude other elements, components, parts or steps.

The embodiments of the present invention are described in a progressive manner, the emphasis of each embodiment is different from that of the other embodiments, and reference can be made to each other for the identical or similar parts of the embodiments. The above embodiments are intended only for explaining the technical idea and features of the present invention, with the purpose of enabling the persons who are familiar with this technology to comprehend and implement the content of the invention, and thus cannot limit the scope of protection of the present invention. Any equivalent changes or modifications made according to the spiritual essence of the invention should be covered within the scope of protection of the present invention.

The invention claimed is:

1. A fracturing method for creating a complex crack network by intermittent fracturing on site, wherein the method comprises the following steps:

a) mounting a well head, specifically including: connecting a high pressure manifold to a well head apparatus, connecting a fracturing fluid storage tank and a sand storage tank to the sand blending truck, connecting the sand blending truck with the fracturing truck, and connecting the fracturing truck with the high pressure manifold;

b) pumping a fracturing fluid into an oil well to enter a reservoir by means of a fracturing truck, until after a pumping pressure has reached a preset pressure that is a rupturing pressure so that fractured cracks are created;

c) stopping step (b) after a preset condition has been reached, the preset condition is that the time for continuing pumping the fracturing fluid into the fractured cracks is two minutes;

d) performing under-pressure shut-in for the oil well;

e) stopping step (d) when a signal detecting truck cannot receive an obvious microseismic signal in the under-pressure shut-in process, in the under-pressure shut-in process, a sound emission situation in the pumping process of the fracturing fluid is detected by a radio detector of the signal detecting truck, and the shut-in operation is stopped when the signal detecting truck cannot receive the obvious microseismic signal;

f) repeating step (b) through (e) multiple times at a same location;

g) pumping the fracturing fluid into the oil well to enter the reservoir by the fracturing truck until an amount of the pumped-in fracturing fluid reaches a design pump-in liquid amount;

h) pumping a sand-carrying fluid into the oil well to enter the reservoir by means of a sand blending truck and the fracturing truck after the amount of the fracturing fluid pumped in has reached the design pump-in liquid amount; and i) stopping step (h) after the amount of the sand-carrying fluid pumped-in has reached a preset sand adding amount.

2. The fracturing method for creating a complex crack network by intermittent fracturing on site according to claim 1, wherein the fracturing fluid is a slickwater fracturing fluid.

3. The fracturing method for creating a complex crack network by intermittent fracturing on site according to claim 1, wherein an injection pump of the fracturing truck is closed during the under-pressure shut-in process of the oil well.

4. The fracturing method for creating a complex crack network by intermittent fracturing on site according to claim 1, wherein a radio detector of the signal detecting vehicle continuously detects an acoustic emission situation during the pumping of the fracturing fluid.

5. The fracturing method for creating a complex crack network by intermittent fracturing on site according to claim 4, wherein the radio detector is applied at a same time as an injection pump of the fracturing truck is in a closed state and during the under-pressure shut-in for the oil well.

6. The fracturing method for creating a complex crack network by intermittent fracturing on site according to claim 1, wherein the microseismic signal is monitored during step (d).

7. The fracturing method for creating a complex crack network by intermittent fracturing on site according to claim 6, wherein the microseismic signal is monitored after an injection pump of the fracturing truck is in a closed state.

8. The fracturing method for creating a complex crack network by intermittent fracturing on site according to claim 1, comprising mounting a well head with a high-pressure manifold.

9. The fracturing method for creating a complex crack network by intermittent fracturing on site according to claim 8, comprising connecting a fracturing fluid storage tank and a sand storage tank to a sand blending truck.

10. The fracturing method for creating a complex crack network by intermittent fracturing on site according to claim 9, comprising connecting the sand blending truck to the fracturing truck.

11. The fracturing method for creating a complex crack network by intermittent fracturing on site according to claim 10, comprising connecting the fracturing truck with the high-pressure manifold.

* * * * *